US005424604A

United States Patent [19]

Hyun

[11] Patent Number: 5,424,604

[45] Date of Patent: Jun. 13, 1995

[54] FOCUS ELECTRODE STRUCTURE OF AN ELECTRON GUN FOR A COLOR PICTURE TUBE

[75] Inventor: Kim W. Hyun, Kumi, Rep. of Korea

[73] Assignee: Gold Star Co., Ltd., Seoul, Rep. of Korea

[21] Appl. No.: 904,478

[22] Filed: Jun. 25, 1992

[30] Foreign Application Priority Data

Jun. 25, 1991 [KR] Rep. of Korea ..... UM 9540/1991

[51] Int. Cl.[6] ..... H01J 29/51

[52] U.S. Cl. ..... 313/414; 313/412

[58] Field of Search ..... 313/414, 412, 449, 460, 313/409, 452

[56] References Cited

U.S. PATENT DOCUMENTS 4,626,738 12/1986 Gerlach ..... 313/449
4,833,364 5/1989 Izumida et al. ..... 313/414
5,010,271 4/1991 Maninger et al. ..... 313/414
5,202,604 4/1993 Kweon ..... 313/414

*Primary Examiner*—Sandra L. O'Shea
*Assistant Examiner*—Vip Patel

[57] ABSTRACT

This invention relates to an electron gun for a color picture tube, comprising a focus electrode structure having three electron beam passage apertures including a center aperture of a circular shape and two side apertures each being of an oblong shape having a major axis extending transversely, being arranged such that the center-to-center distance between adjacent apertures of the three apertures is less than the center-to-center distance between adjacent apertures formed in a control electrode and a screen electrode. This focus electrode structure prevents deterioration of resolution of the picture tube due to changes of electron beam paths resulting from thermal deformation of the electrodes during operation of the gun.

3 Claims, 5 Drawing Sheets

FOCUS ELECTRODE STRUCTURE OF AN ELECTRON GUN FOR A COLOR PICTURE TUBE

BACKGROUND OF THE INVENTION

1. Field of the Invention

This invention relates to an electron gun for a color picture tube, and more particularly a focus electrode structure of an electron gun, which is capable of preventing deterioration of resolution of a picture tube due to changes in electrons beam paths resulting from thermal deformation of electrodes during operation of the electron gun.

2. Description of the Prior Art

Generally, a color picture tube is made of glass and comprises a panel 11 having a phosphor screen 12 on applied to its inner surface, and a funnel 13 having a neck portion of a reduced cross-section, as shown in FIG. 1 of the accompanying drawings. In addition, the tube includes an electron gun 8 mounted within the neck portion of the funnel to emit thermions and a color selection shadow mask 14 disposed in predetermined spaced relation to the phosphor screen 12. Moreover, a deflection yoke 15 for deflecting an electron beam is mounted around the rear portion of the funnel 13.

The detailed construction of the electron gun 8 used in the color picture tube is shown in FIG. 2. The gun comprises three coplanar cathodes 9 each associated with a heater 10, a control electrode 4 and a screen electrode 5 disposed in front of the cathodes 9, and a focus electrode 3, an anode 6 and a shield cup 7 arranged in front of the screen electrode 5, in the order recited. The focus electrode 3 includes an electrode body 1 and a cap 2. The electrodes 3,4,5 and 6 are arranged in a line along electrical insulator rods(not shown), such as bead glasses, and fixedly mounted on the rods in a predetermined space relation to one another. Further, each of the electrodes has three electron beam passage apertures disposed in line in a common horizontal plane.

With the color picture tube thus constructed, as the heaters 10 are energized to generate heat, the cathodes 9 emit thermions which pass through the respective electrodes of the electron gun 8 as three coplanar electron beams. Then the beams pass through the shadow mask 14 to the screen 12 with phosphor coated thereon to cause luminescence of the phosphor material, thereby producing a picture image.

Moreover, there are formed within the electron gun 8 two electrostatic focusing lens parts, one of them being a pre-focusing lens part formed by a potential difference between applied voltage of the screen electrode 5 and voltage of the focus electrode 3, and the other being a main focusing lens part formed by a potential difference between voltage of the focus electrode 3 and voltage of the anode 6. The pre-focusing lens part acts to reduce diffusion of the electron beams emitted from the cathodes 9, and the main focusing lens part acts to focus the beams on the screen. Therefore, if central axes of the paths of the electron beams do not coincide exactly with a central axis of the main focusing lens, haze is formed at a beam spot, resulting in considerable deterioration of resolution of the color picutre tube.

Referring to FIG. 5, illustrating in plan view the electrode body of the focus electrode used in the prior art electron gun, the electrode body 1 has three circular apertures a, b, and c arranged in line at equal distances $t_1$ to permit passage of three electron beams. Each of the apertures is approximately 1.5 mm in diameter. The prior art focus electrode having the beam passage apertures of the same circular shapes as described above have exhibited the following drawback. That is, during operation of the pricture tube, high temperature(about 780°~820° C.) generated by the heaters 10 gives rise to thermal deformation of the control and screen electrodes 4 and 5. As a result, the control and screen electrodes 4 and 5 suffer thermal expansion in the direction indicated by the arrows in FIG. 4, as a result of which the central axes of the side apertures b and c of the electrodes are displaced to the positions shown by the dotted lines, whereby the electron beams are directed with their central axes deviated from the central axes of the main lenses M, thereby producing haze at the beam spot on the screen and lower resolution of the picture tube. As a result, while the center apertures a of the control and screen electrodes undergo only enlargement in diameter under the influence of the heat without changes of their centers, the side apertures b and c are subjected to displacement of their centers. As a result, the electrons emitted from the cathodes 9 pass through the side apertures along the paths offset from their normal paths, and then deviate from the central axes of the main lenses to be deflected from the normal paths toward the center of the electrode body.

SUMMARY OF THE INVENTION in view of the aforesaid problem of the prior art, it is an object of the present invention to provide a focus electrode structure of an electron gun for a color picture tube, which compensates for changes in positions of control and screen electrodes owing to heat generated by heaters, thereby directing electron beams along the paths coinciding with the central axes of the main lenses.

To achieve the above object, there is provided according to one embodiment of the present invention, an electron gun for a color picture tube, comprising a plurality of electrodes including cathodes, a control electrode, a screen electrode, a focus electrode, and an anode to generate and direct electron beams along coplanar paths toward a screen of the picture tube, wherein the focus electrode is formed with three electron beam passage apertures including a center aperture of the circular shape and two side apertures each being of an oblong shape having a major axis extending transversely, and being arranged such that the center-to-center distance between adjacent apertures of the three apertures is less than the center-to-center distance between adjacent apertures of electron beam passage apertures formed in the control and screen electrodes.

DESCRIPTION OF THE PREFERRED EMBODIMENT

The invention will now be described in detail, by way of example, with reference to the accompanying drawings.

Figure 1:
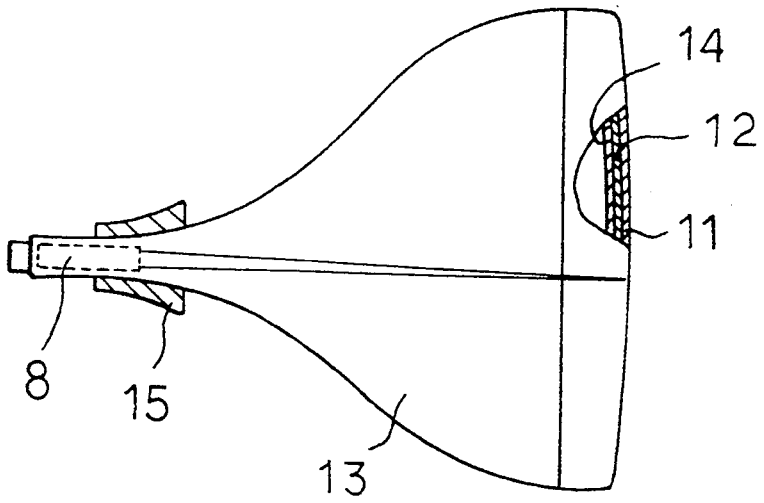
FIG. 1 PRIOR ART
FIG. 1 is a side view, in partial section, of a conventional color picture tube.
Figure 2:
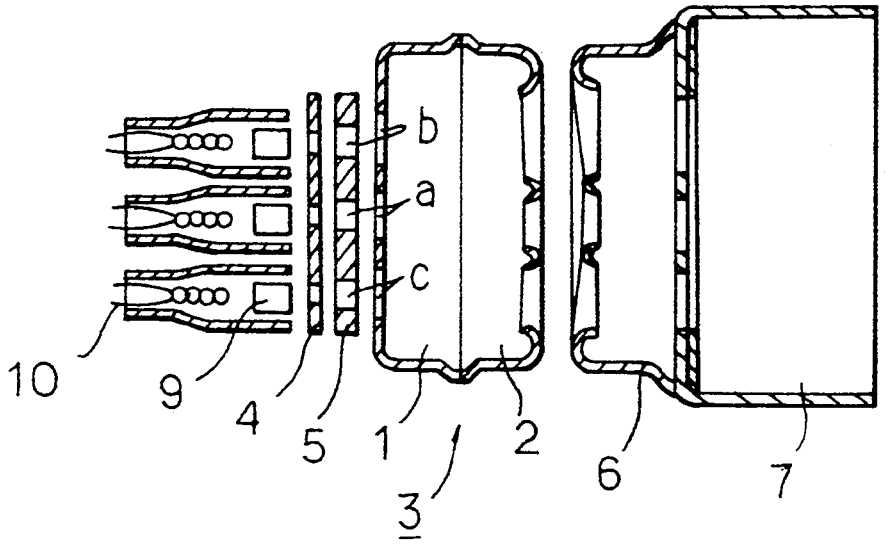
FIG. 2 PRIOR ART
FIG. 2 is a cross-sectional view of a conventional electron gun.
Figure 3:
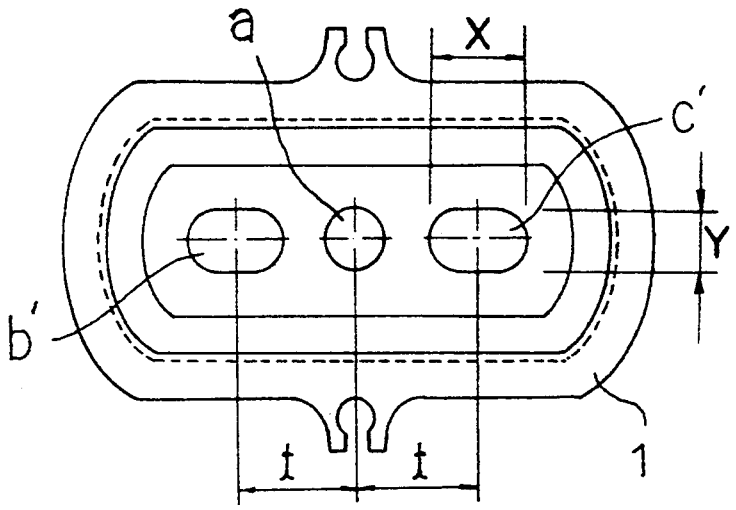
FIG. 3 is a front view of an electrode body of a focus electrode according to the present invention.

Referring to FIG. 3 illustrating in front view an electrode body 1 of a focus electrode according to the preferred embodiment of the present invention, the electrode body is identical in general construction with that of the prior art with the exception of the configuration of three electron beam passage apertures formed therein. Departing from the prior art electrode body having three beam passage apertures of the same circular shapes, the electrode body according to the present invention has three beam passage apertures including a center aperture a of a circular shape and side apertures b′ and c′ of the same oblong shapes. Although the side apertures b′ and c′ may be modified to be of various shapes other than the oblong shape, in the preferred embodiment, an shown in FIG. 3, each side aperture is of an oblong shape having a transversely extending major axis and sized such that assuming "x" is a dimension, i.e. the length of the minor axis, "x" satisfies the following inequality: $y+0.04 \leqq x \leqq y+0.14$.

Figure 5:
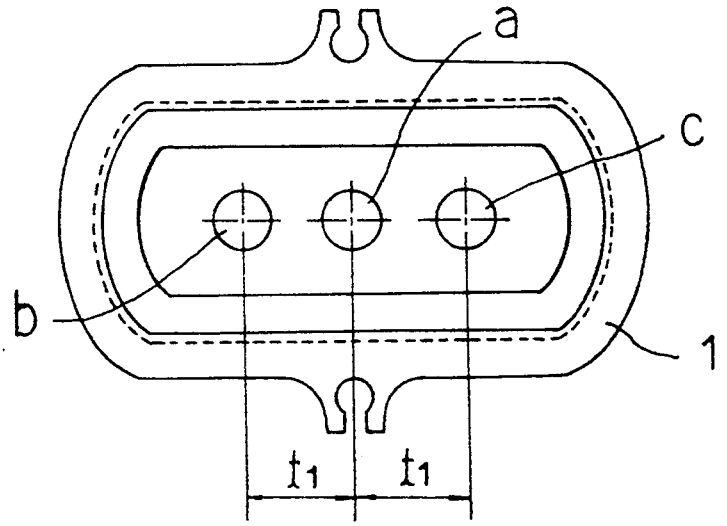
FIG. 5 PRIOR ART
FIG. 5 is a front view of an electrode body of a focus electrode according to the prior art.
Figure 4:
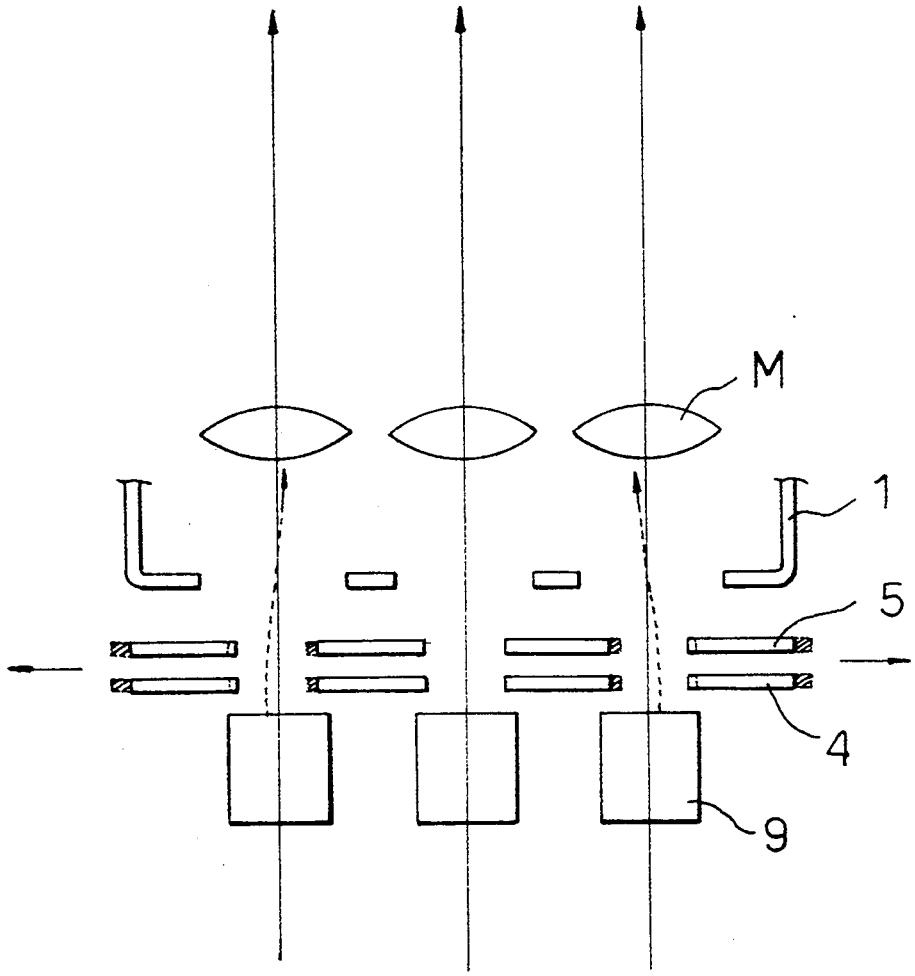
F I G . 4 PRIOR ART
FIG. 4 is an explanatory view showing paths of electron beams incident upon main lenses.
Figure 6:
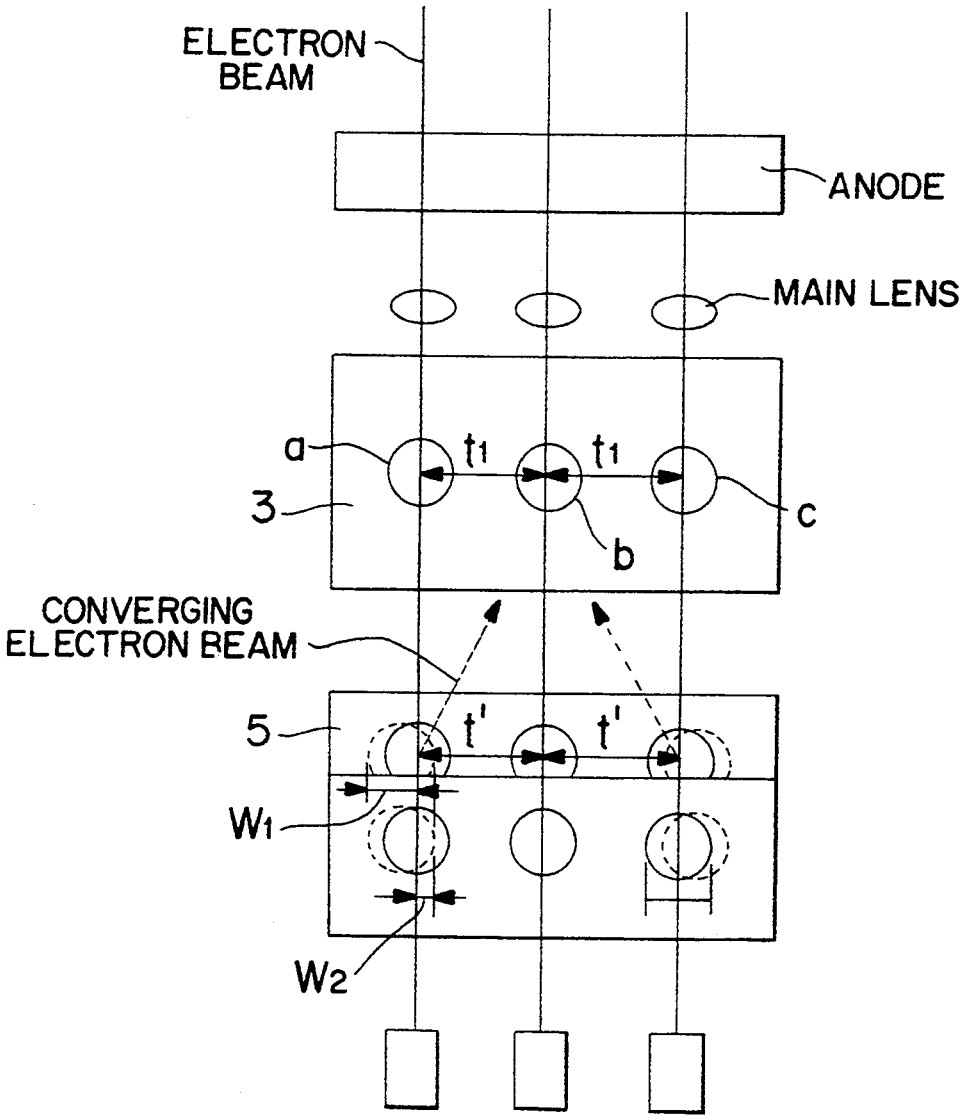
FIG. 6 PRIOR ART
FIG. 6 is an explanatory view of the center-to-center distance between the apertures of the focus control and screen electrodes according to the prior art.
Figure 7:
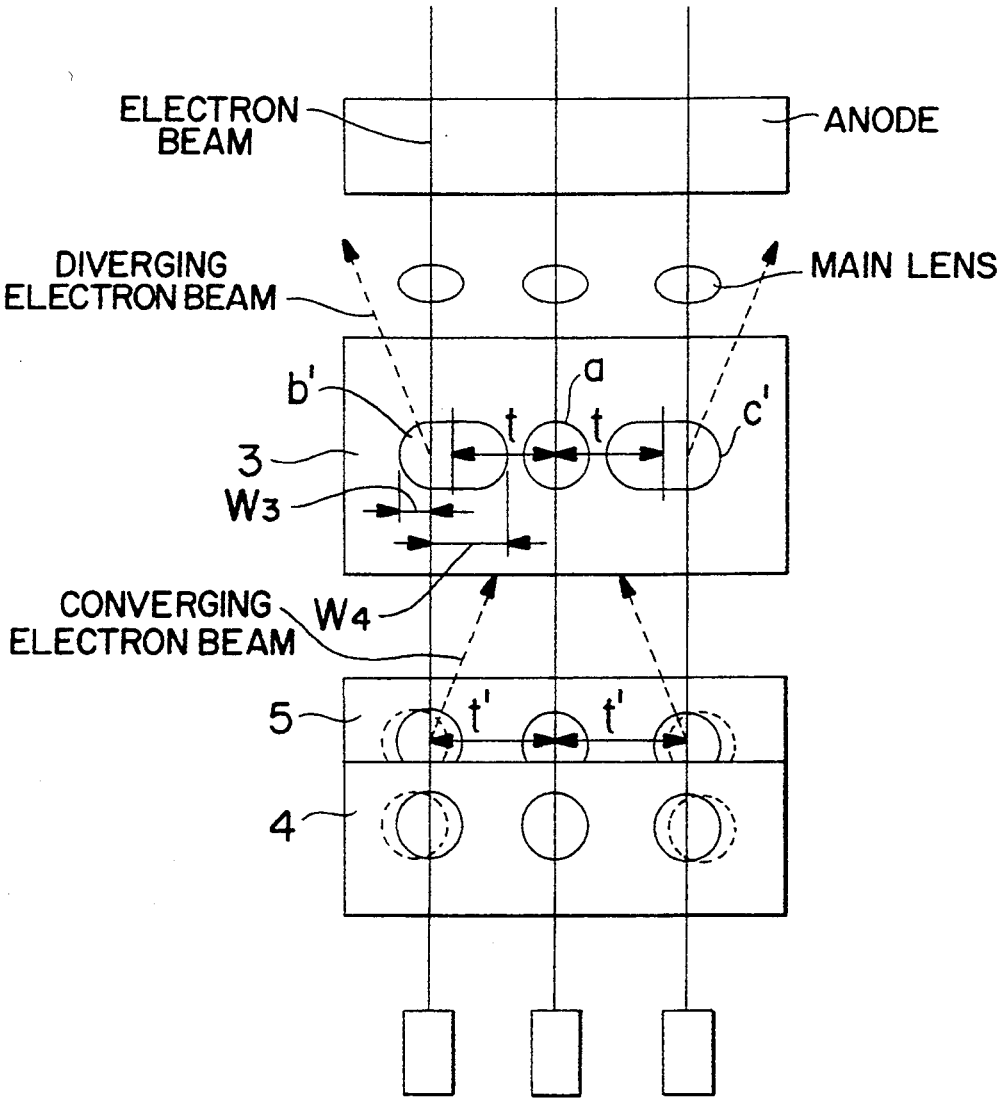
FIG. 7 is an explanatory view of the center-to-center distance between the apertures of the focus control and screen electrodes according to the present invention.

In addition, as shown in FIGS. 3 and 7 the distance t between the central axis of the center aperture a and the central axis of each of the side apertures b′ and c′ is determined to be slightly, about 0.02~0.03 mm less than the distance $t_1$ in the prior art as shown in FIGS. 5, and 6 or the center-to-center distance between adjacent apertures of electron beam passage apertures formed in control and screen electrodes.

In FIG. 6:

$t_1$ is the center-to-center distance between apertures of the focus electrode;

t′ is the center-to-center distance between apertures of the screen electrode;

3 is the focus electrode;

4 is the control electrode;

5 is the screen electrode;

W1 is the distance between the left inner surface of circular aperture 4 or 5 and the line of electron beam;

W2 is the distance between the right inner surface of circular aperture 4 or 5 and the line of electron beam.

In FIG. 7:

t is the center-to-center distance between apertures of the focus electrode;

t′ is the center-to-center distance between apertures of the screen electrode;

3 is the focus electrode

4 is the control electrode

5 is the screen electrode

W3 is the distance between the left inner surface of circular aperture 3 and the line of electron beam;

W4 is the distance beteen the right inner surface of the circular aperture 3 and the line of electron beam. Electrodes 3, 4 and 5 each have positive charge so that they pull the electron beam when it approaches. Thus, as shown in FIG. 6 in the prior art apparatus when apertures A and C of the control electrode 4 and screen electrode 5 move outward from the center aperture B due to heating, the result is that the electron beam is converged after passing closer to the inner sides of apertures A and C of the control electrode and screen electrode. As shown in FIG. 7, applicant's apparatus corrects this deviation by virtue of "t" of the focus electrode being made slightly less than "t'" of the control and screen electrodes. Thus, the outer apertures of B′ and C′ are closer to the center of the beam and thus act on the beam so as to straighten the alignment of the beam which previously was converging. Thus, applicant's invention counteracts the problem which occurs in the prior art.

With the construction of the present invention as described above, since each of the central axes of the side apertures b′ and c′ the focus electrode body 1 forming the pre-focusing lens is deviated approximately 0.02~0.03 mm from each of the central axes of the side apertures of the control and screen electrodes 4 and 5, even though the control and screen electrodes undergo thermal deformation owing to heat generated by the heaters during operation of the electron gun, the traveling paths of the electron beams are compensated by the eccentricity to coincide with the central axes of the main lenses. That is, the deviations of the electron beam paths, which occur during the course of the different thermal expansions of the control and screen electrodes 4 and 5 by the heat of the heaters, or during the course of the restoration of the electrodes from the expanded states to the original normal states, are accommodated by the oblong configurations of the side electron beam passage apertures b′ and c′ of the focus electrode body 1.

From the foregoing it will be appreciated that the present invention allows excellent picture quality to be obtained by eliminating the drawback of the prior art arrangement, such as a lowering of resolution of the picture tube, resulting from changes of the electron beam paths owing to the thermal expansions of the electrodes.

While the invention has been shown and described with particular reference to a preferred embodiment thereof, it will be understood that many variations and modifications may be made therein without departing from the spirit and scope of the invention as defined in the appended claims.

What is claimed is:

1. An electron gun for a color picture tube, comprising:

a plurality of electrodes including cathodes, a control electrode, a screen electrode, a focus electrode, and an anode to generate and direct electron beams along coplanar paths toward a screen of the color picture tube, wherein the focus electrode includes three electron beam passage apertures including a center aperture of a circular shape and two side apertures, each of an oblong shape having a major axis extending transversely, such that thermal deformations of said control electrode and said source electrode do not degrade picture resolution;

wherein a center-to-center distance between adjacent apertures of said focus electrode is less than a center-to-center distance between adjacent apertures of said control electrode and said screen electrode.

2. The electron gun of claim 1, wherein for each of said two side apertures, x is a horizontal dimension of the oblong shape and y is a vertical dimension of the oblong shape, and $y+0.04 \leqq x \leqq y+0.14$.

3. The electron gun of claim 1, wherein a difference between the center-to-center distance between adjacent apertures of said focus electrode and the center-to-center distance between adjacent apertures of said control electrode and said screen electrode is between 0.02 and 0.03 mm.

* * * * *